United States Patent [19]

Kazumi

[11] Patent Number: 4,783,073

[45] Date of Patent: Nov. 8, 1988

[54] LIQUID CRYSTAL DISPLAY GAMING APPARATUS EQUIPPED WITH A SAVINGS BOX

[76] Inventor: Chiba Kazumi, 369-33 Honmokumotomachi Naka-ku, Yokohama-shi, Kanagawa 231, Japan

[21] Appl. No.: 870,277

[22] PCT Filed: Nov. 9, 1984

[86] PCT No.: PCT/JP84/00540

§ 371 Date: Aug. 22, 1986

§ 102(e) Date: Aug. 22, 1986

[87] PCT Pub. No.: WO86/02854

PCT Pub. Date: May 22, 1986

[51] Int. Cl.[4] ..... A63F 1/00; A63F 9/00

[52] U.S. Cl. ..... 273/85 CP; 273/138 A; 273/1 E; 446/9; 446/10; 194/346

[58] Field of Search ..... 273/138 A, 143 R, 85 CP, 273/1 E, 85 G; 446/8–10; 194/346

[56] References Cited

U.S. PATENT DOCUMENTS

| | | | |
|---|---|---|---|
| 553,078 | 1/1896 | Smith et al. | 446/10 |
| 3,464,693 | 9/1969 | Bailey | 273/143 R |
| 3,899,064 | 8/1975 | Martin | 194/242 |
| 4,002,335 | 1/1977 | Bailey | 273/1 E |
| 4,393,972 | 7/1983 | Maloy | 194/346 |
| 4,679,143 | 7/1987 | Hagiwara | 273/138 A |

*Primary Examiner*—Maryann Lastova

*Attorney, Agent, or Firm*—Cushman, Darby & Cushman

[57] ABSTRACT

A savings bank gaming apparatus in which a game is played by inserting a coin and then by operating a keyboard and the game and results appear on a liquid crystal display. When a control circuit determines the game has been won, the inserted coin is returned to a coin return and when lost, directed to a coin storage box. The coin after insertion is held at a fork by a gate which then directs the coin to one of the two forks in accordance with the game results.

3 Claims, 5 Drawing Sheets

LIQUID CRYSTAL DISPLAY GAMING APPARATUS EQUIPPED WITH A SAVINGS BOX

BACKGROUND OF THE INVENTION

1. Field of the Invention

This invention relates to a gaming apparatus or equipment using a liquid crystal display.

A liquid crystal display-equipped gaming apparatus according to this invention is operatively connected with a savings box in such a way that: when a coin is put in the coin slot of the gaming apparatus it is temporarily deposited, and it is returned to a player if he gains a good score or a winning combination of cards at the end of the game, and otherwise the coin is shifted to the savings box for deposit.

2. Description of the Related Art

A gaming apparatus or equipment comprising an input means for providing necessary pieces of information for performing a given game, a control means for computing the gaming logic according to a program and a liquid crystal display showing the proceeding of the game is well known, as for instance in Japanese Patent Application Laid-Open Nos. 56-23988; 57-66783; 57-1777784 and other official gazettes. Nobody can play the game for money because these are not gambling equipments. Therefore there is no problem of committing any crimes prescribed in the law when people play a game with such gaming equipments, but the game is less exciting than the one which is played for money or gamble. In fact, it is almost impossible to devise a new game which would cause as much excitement as would arise on the gamble. Even if a game which could be played with much fun should be devised, people would get sick of the game soon. So great an excitement as people had when playing the game for the first time, will not arise again. As a matter of fact coin-operated gaming equipments which are designed to be able to play the game for money, or gambling equipments have gained general popularity. The gambling equipment, however, is most liable to cause social criminal problems, and is most harmful to minor-aged people.

SUMMARY OF THE INVENTION

This invention is based on the idea that if a game could cause a psychological effect similar to that which would be caused by a gamble the game would gain an ever lasting popularity, but causing no harm to people. In coin-operated gaming apparatus according to this invention the game starts when a coin is put in the coin slot of the gaming apparatus, and if the player's score is below a predetermined number of points or if the player fails to gain a winning combination of cards, the coin is put in a savings box integrally attached to the gaming equipment, thus permitting the player to play the game with as much fun as he could gain from a gamble, not losing his money but depositing the same in the savings box. If the player's score is above a predetermined number of points, or if the player gains a winning combination of cards, the coin returns to him. It should be noted that the same coin as was put in the coin slot of the gaming apparatus is returned to the player at the end of the game even if he wins the game, and that no multiplied amount of money can be obtained by the player, thus eliminating any tint of gamble from the game and saving money by putting it in the savings box in return for the fun in the game. A savings box-equipped gaming apparatus according to this invention comprises: input means for inputting necessary pieces of information for playing a game; control means for computing the game logic according to a program; a liquid crystal display operatively connected to the input and control means for showing the proceeding of game; a savings box; a coin detector provided in a coin passage extending from a coin slot to the savings box and to a coin return, said coin detector being responsive to the coin when putted in the coin slot for starting the program of the game; and selector means for allowing the coin to take the way to the coin return when the player's score is above a predetermined number of points or when he gains a winning combination of cards and for allowing the coin to take the other way to the savings box when the player's score is below the predetermined number of points or when he fails to gain the winning combination of cards. With this arrangement a player enjoy, saving his money in spite of gaining as much excitement as he would gain on a gamble, still eliminating any possibility of inducing the player to the habit of gambling. Thus, the gaming apparatus will cause no harm to minor or aged people.

PREFERRED EMBODIMENT OF THE INVENTION

Figure 1:
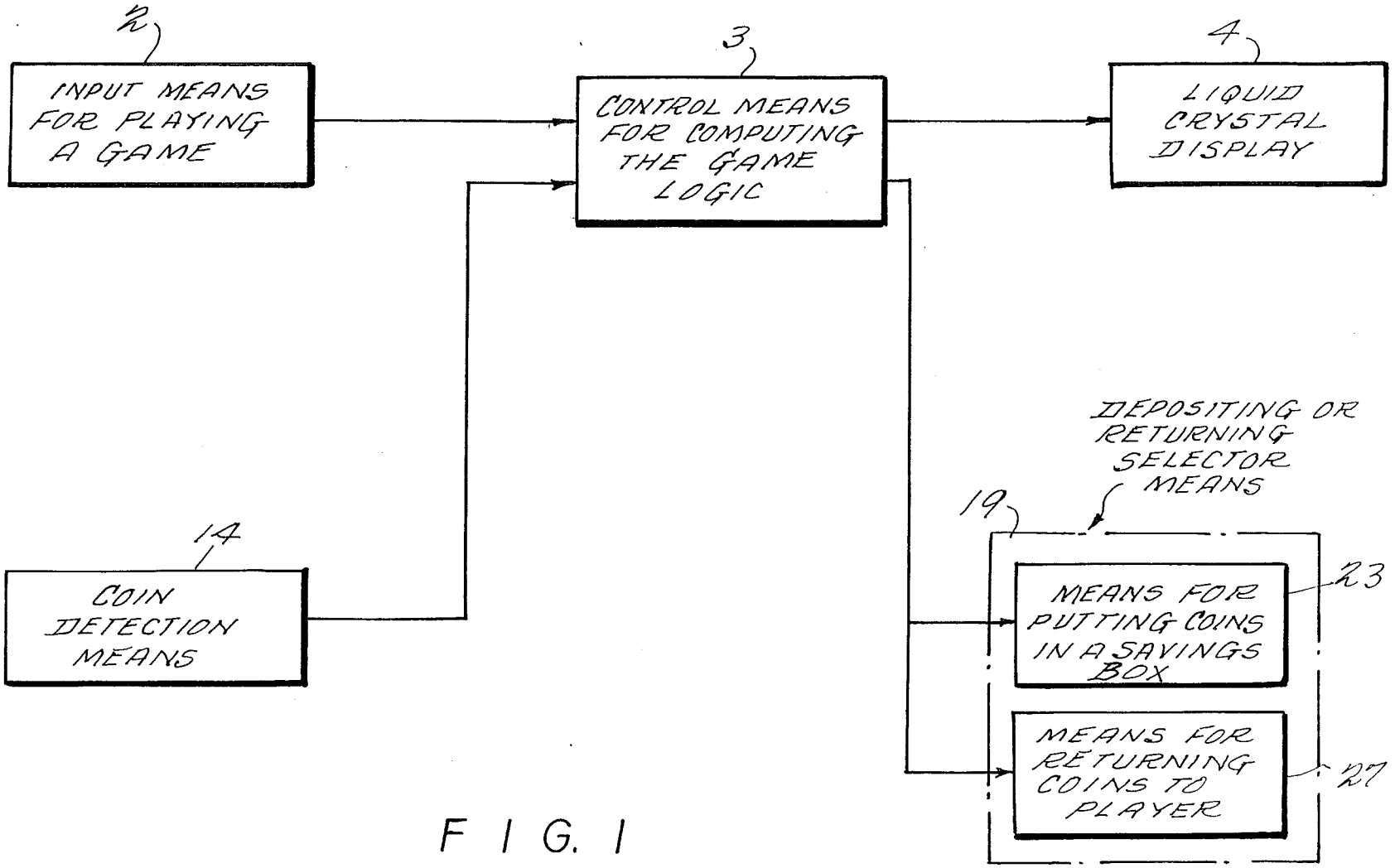
FIG. 1 is a block diagram showing the general construction of a savings box-equipped gaming apparatus according to one embodiment of the invention.
Figure 2:
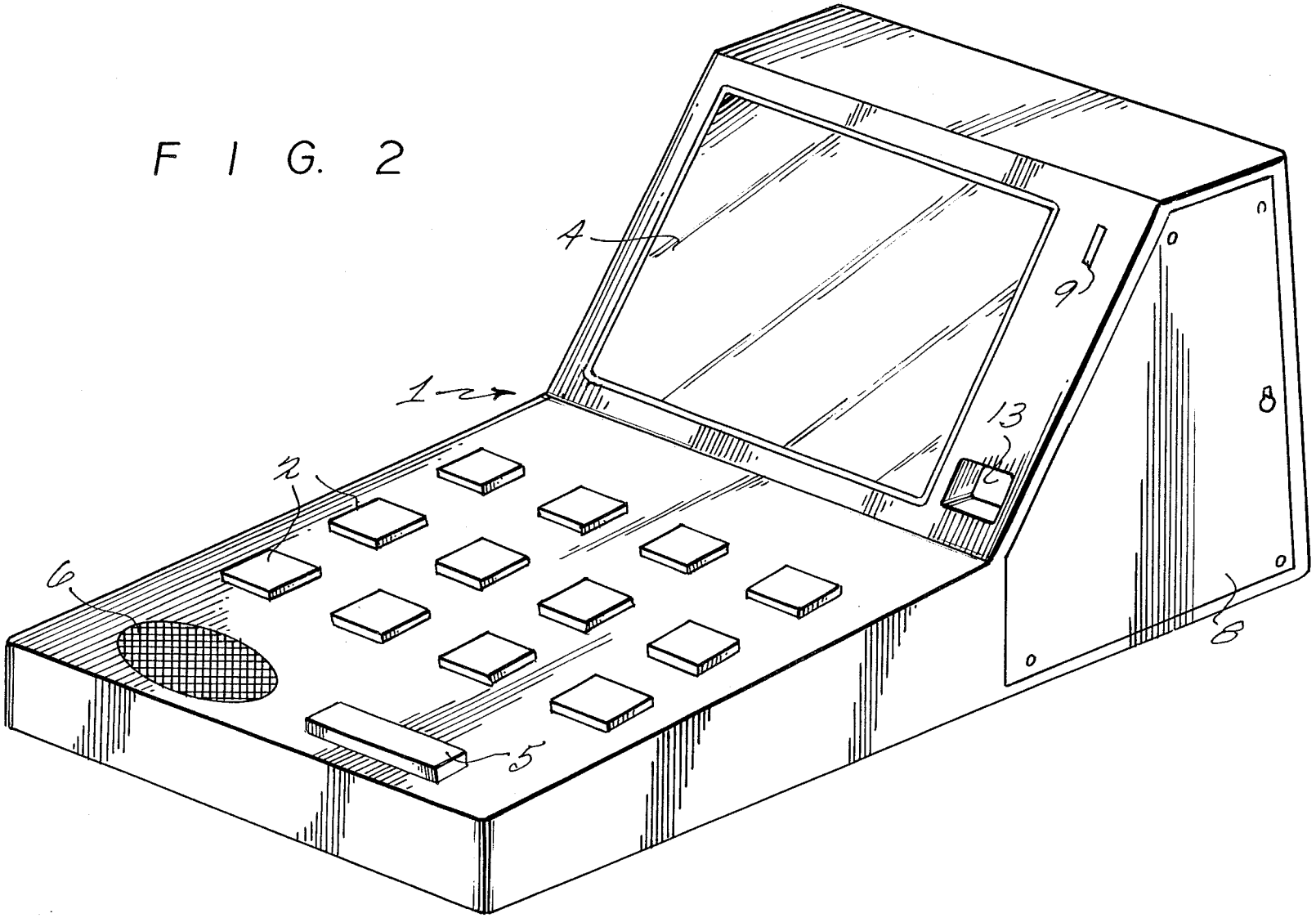
FIG. 2 is a perspective view of the savings box-equipped gaming apparatus.
Figure 3:
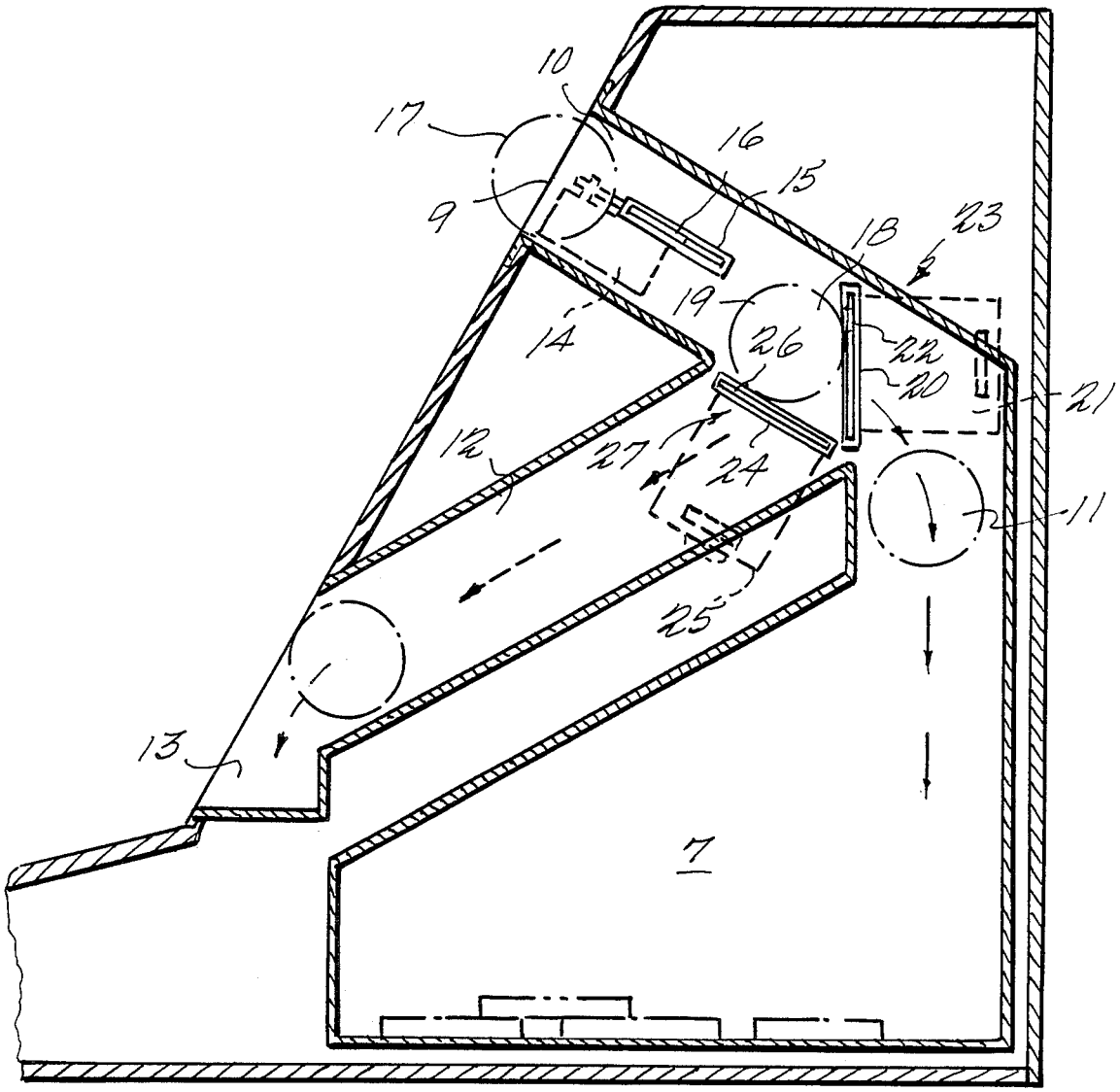
FIG. 3 is a longitudinal section showing an electromagnetic driving type coin receiving-and-returning means.
Figure 4:
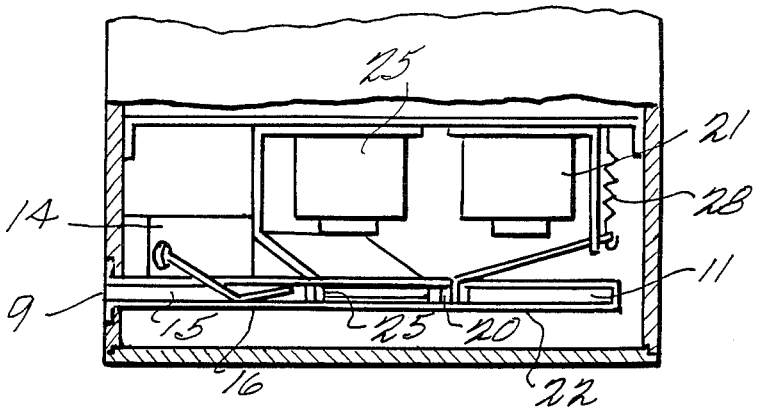
FIG. 4 is a cross section showing the electro-magnetic type depositing-or-returning selector.

FIG. 1 shows the general construction of a savings box-equipped gaming apparatus using a liquid crystal display according to one embodiment of this invention. As is the case with a conventional gaming apparatus, it comprises input means 2 in the form of a combination of switching devices, keys and the like for playing the game, control means 3 in the form of integrated circuits for carrying out logic operations necesary for playing the game, and a liquid crystal display 4 driven by the control means. On the console there are a switch 5 for putting an electric power supply such as an electric battery in circuit with the inner circuit of the gaming apparatus, a speaker and other accessories for increasing the fun with which a player plays the game. The arrangement described so far is well known in the art and a variety of gaming equipments have been proposed and commercially available, as for instance: gaming apparatus for simulating different kinds of sports; ones for simulating chess, bingo, cards, roulette, "go" and other games; ones for simulating different kinds of puzzles, number-matching games and other educational games; and ones for simulating shooting and wars. Gaming apparatuses commercially available range from hand size to as large a size as a TV set. Input means and liquid crystal displays incorporated in such gaming apparatus are designed elaborately in the hope of making the gaming apparatuses attractive in appearance. A liquid crystal display-equipped gaming apparatus according to this invention is characterized in that it has a savings box 7 integrated therewith. In FIGS. 2 and 3 the savings box 7 is shown as being behind the liquid crystal display 4. Otherwise, the savings box in placed in the vicinity of the input means 2. A lid 8 may be provided to the savings box 7, thereby permitting the player to take the coins out of the savings box after finishing the game. Otherwise, the savings box 7 may be closed, not allowing the withdrawal of money from the savings box once the money has been put thesein.

As shown, a coin passage 10 extends from a coin slot 9, and divides itself into two branch passages, one branch 11 extending to the savings box 7, and the other branch 12 extending to the coin return 13. These coin passages are designed to be large enough to allow the biggest coin to pass therethrough, thus naturally permitting coins of different sizes to pass therethrough. As shown, a coin detector in the form of switch 14 is provided to the inlet passage 10. A switch rod 16 projects from an opening 15 on one side wall of the coin passage to extend crosswise. With this arrangement if a coin is put in the coin shot, the coin rolls down to push the switch rod 16 to make the switch 14 turn on, thereby starting the game. A coin depositing-or-returning selector 19 is provided to the forked part of the coin passage. It is responsive to the signal from the control means 3 for allowing the coin 17 to take the way 12 to the coin return 13 when the player's score is above a predetermined number of points, or when the player gains a winning combination of cards, and for allowing the coin 17 to take the other way 11 to the savings box 7 when the player's score is below the predetermined number of points or when the player failes to gain a winning combination of cards. The closing plate 22 of an electromagnetic gate 21 projects from a slot 20 of the passage wall to normally close and momentarily open the inlet of the coin passage 11 to the savings box 7, thereby constituting a depositing means 23 for the savings box 7. On the other hand, the closing plate 26 of an electromagnetic gate 25 projects in the way from a slot 24 of the passage wall to normally close and momentarily open the inlet of the coin passage 12 to the coin return 13, thereby constituting a coin returnning means 27. These closing plates 22 and 26 are normally urged by spring 28 to close the inlets of the branch passages, thereby holding the coin until the game ends. When the game is finished, one of the closing plates is withdrawn from the way, thereby allowing the coin to take one way or the other. Which way the coin may take depends on the outcome of the game. More specifically, the central processing unit (CPU) or memory apparatus (ROM) constituting a part of the control means 3 directs a signal to the electro-magnetic gate 25 when a player gains a score above a predetermined number of points or a winning combination of cards, and then the gate 25 opens momentarily, thereby allowing the coin to take the way 12 to the coin return 13.

Figure 6:
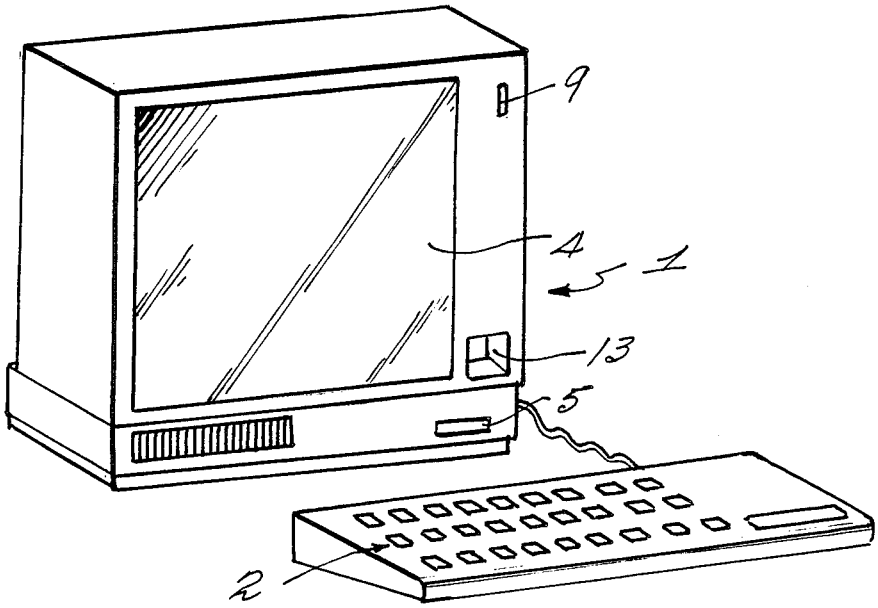
FIG. 6 is a perspective view of a savings box-equipped gaming apparatus according to another embodiment of this invention.
Figure 5:
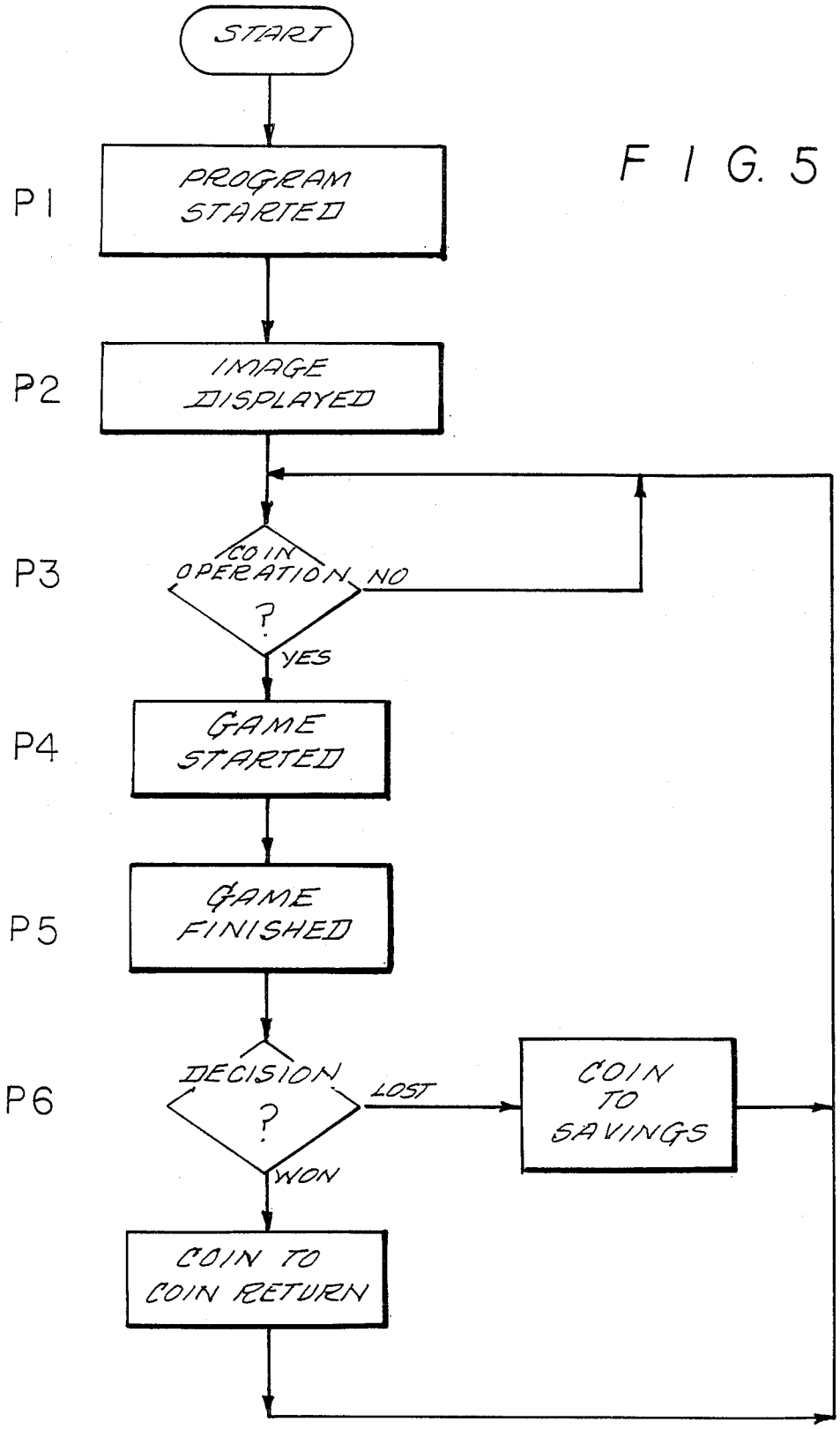
FIG. 5 is a flowchart showing subsequent steps in the operation of the gaming apparatus.

Otherwise, the CPU or ROM directs a signal to the electro-magnetic gate 21 to open the gate momentarily, thereby allowing the coin to take the way 11 to the savings box 7. The coin depositing-or-returning selector means 19 may take another form as, for instance, follows. A rotatable tray is provided to receive a coin when it is put in the coin slot 9 of the gaming apparatus, and the rotatable tray is responsive to a signal from the control means 3 for bringing itself to the savings box 7 or to the coin return 13 depending on the outcome of the game, and then turning the tray upside-down to cause the coin to fall on the selected way. FIG. 6 shows a different arrangement of gaming equipment which looks like a personal computer. FIG. 5 shows a flowchart representing the operation of a gaming apparatus according to this invention. First, the power switch 5 is turned on. If occasions demand, the power supply is put in circuit with the integrated circuits and other electrical devices of the gaming apparatus all the time. Then, the computer program starts (Step P1), and images appear on the screen of the liquid crystal display (Step P2). Assume that a player puts a coin in the coin slot 9 of the gaming equipment. The coin 17 rolls down on the passage 10 to push the switch operating rod 16 of the coin detector 14 (Step P3). Then, a coin-detecting signal is directed to the control means 3 (Step P4). Then, the coin stops at the coin depositing-or-returning selector means 19. Specifically, both of the electro-magnetic gates 21 and 25 are not energized, keeping their plates 22 and 26 in the ways 11 and 12 to the savings box 7 and to the coin return 13, thus not allowing the coin to take either way while the player is playing the game by operating the input means 2 on the console of the gaming equipment. When the game is over in a predetermined length of time (Step P5), the result of the game appears on the screen of the liquid crystal display. In case of a sport game, the liquid crystal display shows what score is achieved by the team selected by the player. In case of playing cards the liquid crystal display shows whether the player gains a winning combination of cards or not. As already described, the control means 3 directs a signal to the electro-magnetic gate 25 for momentarily energizing the same, thereby opening the way 12 to the coin return 13 when the player gains a score over a predetermined number of points or a winning combination of cards (Step P6). The coin thus returned to the player is the exact one which he put in the coin slot of the gaming equipment. Thus, if he puts a "ten-yen" coin in the coin slot, the "ten-yen" coin returns to him. No multiplied amount of money can be paid to him, and therefore no gamble can be played. The player can play the game repeatedly so long as he continues winning games one after another. If he cannot gain a score over a predetermined number of points or a winning combination of cards, the other electro-magnetic gate 21 is energized to open the way 11 to the savings box 7, and then the coin is put in the savings box 7. As is apparent from the above, people can save their money while playing the game with fun. A gaming apparatus according to this invention may be designed to use a coin no matter what kind and size of coin may be, and only the coin which is put in the coin slot of the gaming equipment, returns to the player without being multiplied in amount of value, thus causing no harm even to minor or aged people.

What is claimed is:

1. A savings box gaming apparatus comprising:

a housing;

a liquid crystal display means mounted on said housing for displaying a game to be played and the results thereof;

manually operable means on said housing for playing the game;

control means within said housing connected to said display means and to said manually operable means for controlling said display means in response to the manual operation of said manually operable means according to a stored logic and determining whether the game has been won according to said stored logic;

a coin storage box within said housing;

a coin receiving slot and a coin return on the exterior of said housing;

means defining coin passage including a first path from said receiving slot to a fork, a second path leading from said fork to said coin return and a third path from said fork to said coin storage box;

means connected to said control means for detecting insertion of a coin to initiate a game;

a gate means in said housing for holding said inserted coin in said first path during the game, releasing said inserted coin into said second path when said control means determines the game has been won and into said third path when said control means determines the game has been lost.

2. An apparatus as in claim 1 wherein said passage defining means includes a first electronic gate closing said second path at said fork and a second electronic gate closing said third path at said fork.

3. An apparatus as in claim 2 wherein said first, second and third paths each slope downward.

* * * * *